US012648595B2

(12) United States Patent
DeSouza

(10) Patent No.: US 12,648,595 B2
(45) Date of Patent: Jun. 9, 2026

(54) TUCKING UNDERWEAR

(71) Applicant: Ty Style, Inc., Philadelphia, PA (US)

(72) Inventor: Antoine DeSouza, Philadelphia, PA (US)

(73) Assignee: TY STYLE, INC., Philadelphia, PA (US)

( * ) Notice: Subject to any disclaimer, the term of this patent is extended or adjusted under 35 U.S.C. 154(b) by 0 days.

(21) Appl. No.: 18/408,825

(22) Filed: Jan. 10, 2024

(65) Prior Publication Data

US 2025/0221466 A1 Jul. 10, 2025

(51) Int. Cl.
*A41B 9/02* (2006.01)
*A41B 9/00* (2006.01)

(52) U.S. Cl.
CPC ..... *A41B 9/02* (2013.01); *A41B 9/004* (2013.01)

(58) Field of Classification Search
CPC ..... A41B 9/02; A41B 9/004
USPC ..... 2/403
See application file for complete search history.

(56) References Cited

U.S. PATENT DOCUMENTS

| | | | | | |
|---|---|---|---|---|---|
| 3,487,833 | A * | 1/1970 | Senser | A41B 9/02 | 2/403 |
| 3,499,442 | A * | 3/1970 | Steinmetz | A41B 9/02 | 2/403 |
| 4,173,976 | A * | 11/1979 | Bloomquist | A41B 9/02 | 2/403 |
| 4,875,236 | A * | 10/1989 | Boynton | A41D 7/00 | 2/403 |
| 5,157,793 | A * | 10/1992 | Michels | A41B 9/02 | 2/403 |
| 6,353,940 | B1 * | 3/2002 | Lyden | A41B 9/02 | 2/403 |
| 7,895,676 | B2 * | 3/2011 | Clark | A41B 9/02 | 2/403 |
| 8,601,616 | B2 * | 12/2013 | Radford | A41B 9/02 | 2/403 |
| 11,684,091 | B2 * | 6/2023 | Calamia | A41B 9/026 | 2/405 |
| 2023/0284709 | A1 * | 9/2023 | Hall | A41B 9/004 | |

* cited by examiner

*Primary Examiner* — Timothy K Trieu
(74) *Attorney, Agent, or Firm* — Ballard Spahr LLP

(57) ABSTRACT

An undergarment for use as tucking (or gaff) underwear is disclosed. The undergarment includes a main body include including 4-way stretch fabric. The main body defines a pair of leg openings spaced along a first axis. The main body has a front portion and a rear portion positioned opposite the front portion along a second axis. The undergarment further includes a compression panel that is positioned to cover male genitals of the wearer. The compression panel includes two-way stretch fabric oriented to permit stretching along the first axis and limit stretching along the second axis.

18 Claims, 6 Drawing Sheets

TUCKING UNDERWEAR

FIELD

This application relates to tucking underwear.

BACKGROUND

Tucking underwear (also referred to as a gaff) is used to smooth the front pubic and genital area of an individual assigned male at birth. Tucking techniques for the pubic and genital area (also referred to as "the tuck") vary by individual based on anatomy and personal preference. Tucking underwear is used to hold the tuck in place to create a smooth outline for an extended period. Conventional tucking underwear uses traditional sewing techniques, fabrics, and designs that incorporate non-stretch or limited stretch fabrics as part of a design to better compress or hold the tuck. However, conventional tucking underwear can be uncomfortable for the wearer and otherwise lack sufficient performance.

SUMMARY

Disclosed herein is an undergarment for use as tucking (or gaff) underwear.

In one aspect, the undergarment includes a main body including 4-way stretch fabric. The main body defines a pair of leg openings spaced along a first axis. The main body has a front portion and a rear portion positioned opposite the front portion along a second axis. The undergarment further includes a compression panel that is positioned to cover male genitals of the wearer. The compression panel includes two-way stretch fabric oriented to permit stretching along the first axis and limit stretching along the second axis.

In another aspect, an undergarment can include a main body, the main body including 4-way stretch fabric. The undergarment can further include a compression panel that is positioned to cover male genitals of the wearer. The compression panel can include two-way stretch fabric oriented to permit stretching along the first axis and limit stretching along the second axis. The main body and the compression panel can cooperate to define a pair of leg openings spaced along a first axis. The main body can define a rear portion of the undergarment, and the compression panel can define a front portion of the undergarment.

Additional advantages of the disclosed system and method will be set forth in part in the description which follows, and in part will be understood from the description, or may be learned by practice of the disclosed system and method. The advantages of the disclosed system and method will be realized and attained by means of the elements and combinations particularly pointed out in the appended claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the disclosed apparatus, system, and method and together with the description, serve to explain the principles of the disclosed apparatus, system, and method.

DETAILED DESCRIPTION

Figure 1:
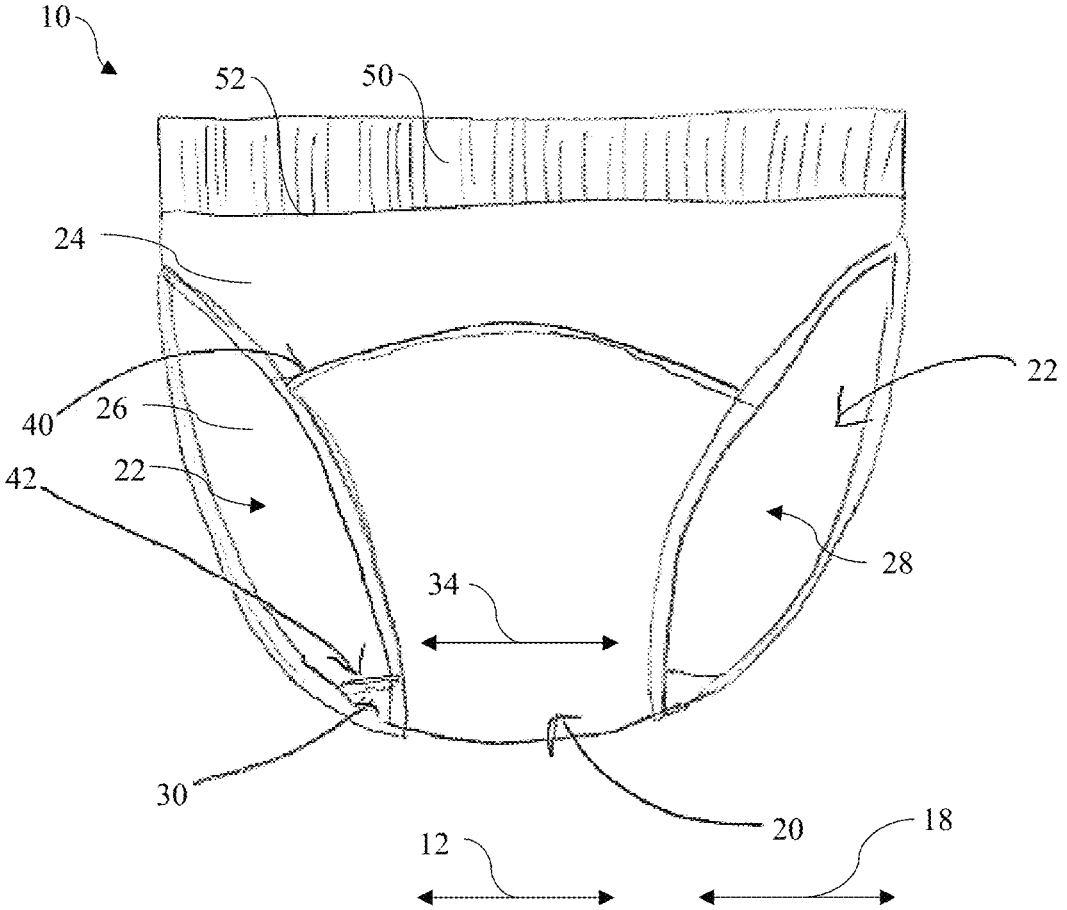
FIG. 1 is a front view of tucking underwear as disclosed herein.

The disclosed system and method may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present invention which will be limited only by the appended claims.

As used in the specification and the appended claims, the singular forms "a," "an" and "the" can include plural referents unless the context clearly dictates otherwise. Thus, for example, unless the context clearly dictates otherwise, disclosure of "a seam" can represent disclosure of embodiments in which only a single such seam is provided, as well as embodiments in which a plurality of such seams are provided.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values or characteristics are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

Figure 2:
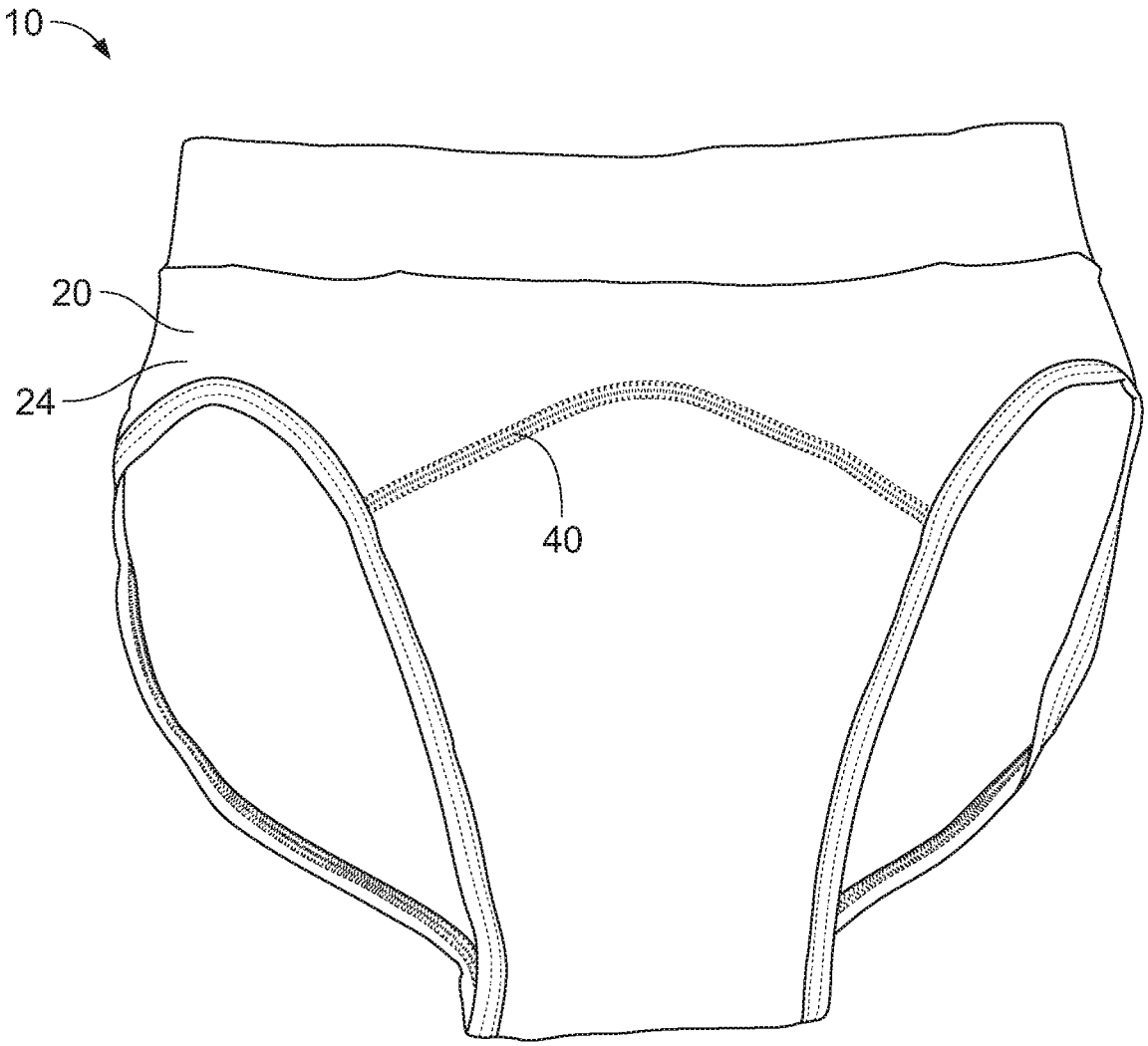
FIG. 2 is a front view of tucking underwear as disclosed herein.
Figure 3:
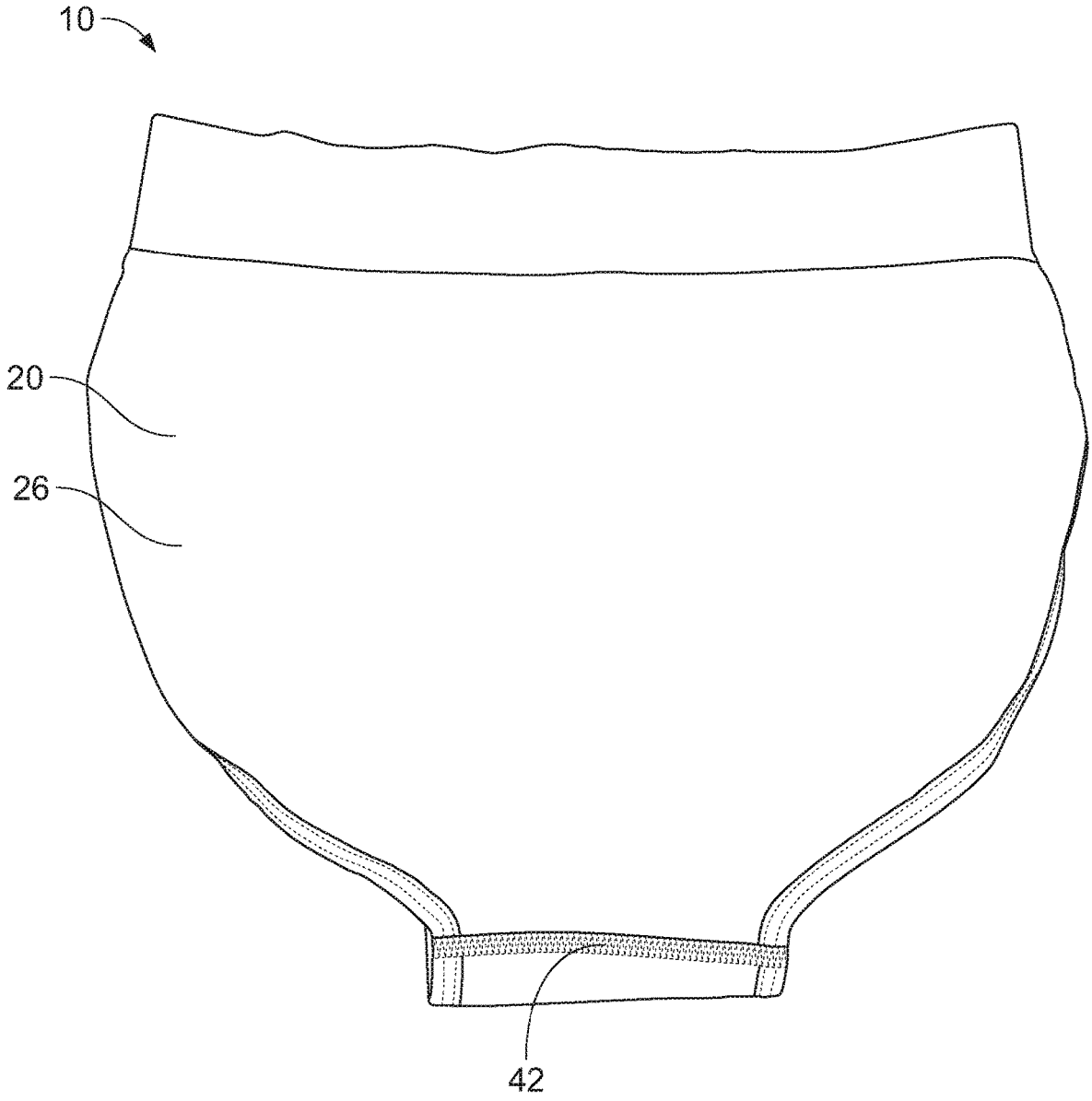
FIG. 3 is a rear view of the tucking underwear of FIG. 2.
Figure 4:
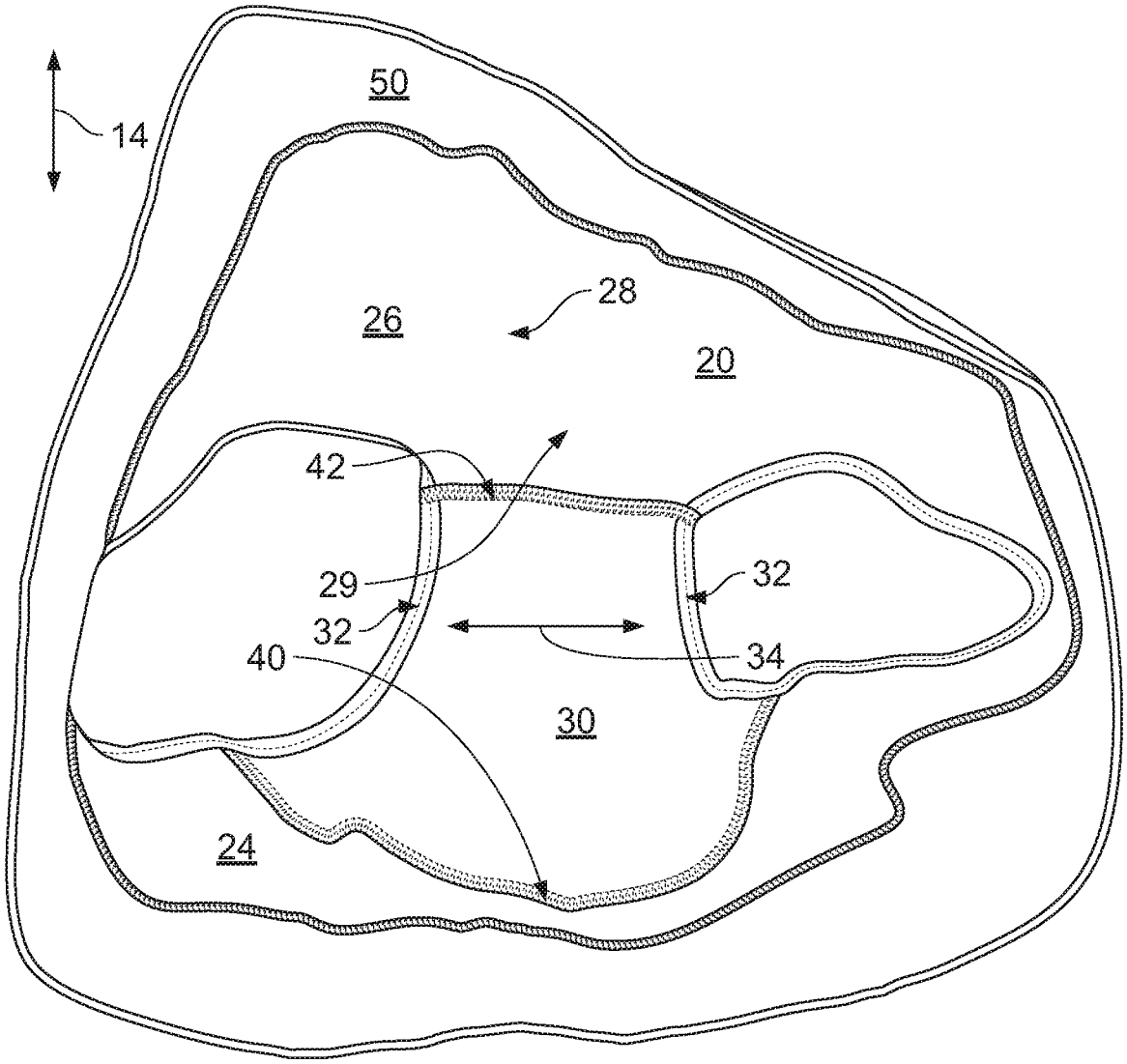
FIG. 4 is a top view of the tucking underwear of FIG. 2.
Figure 5:
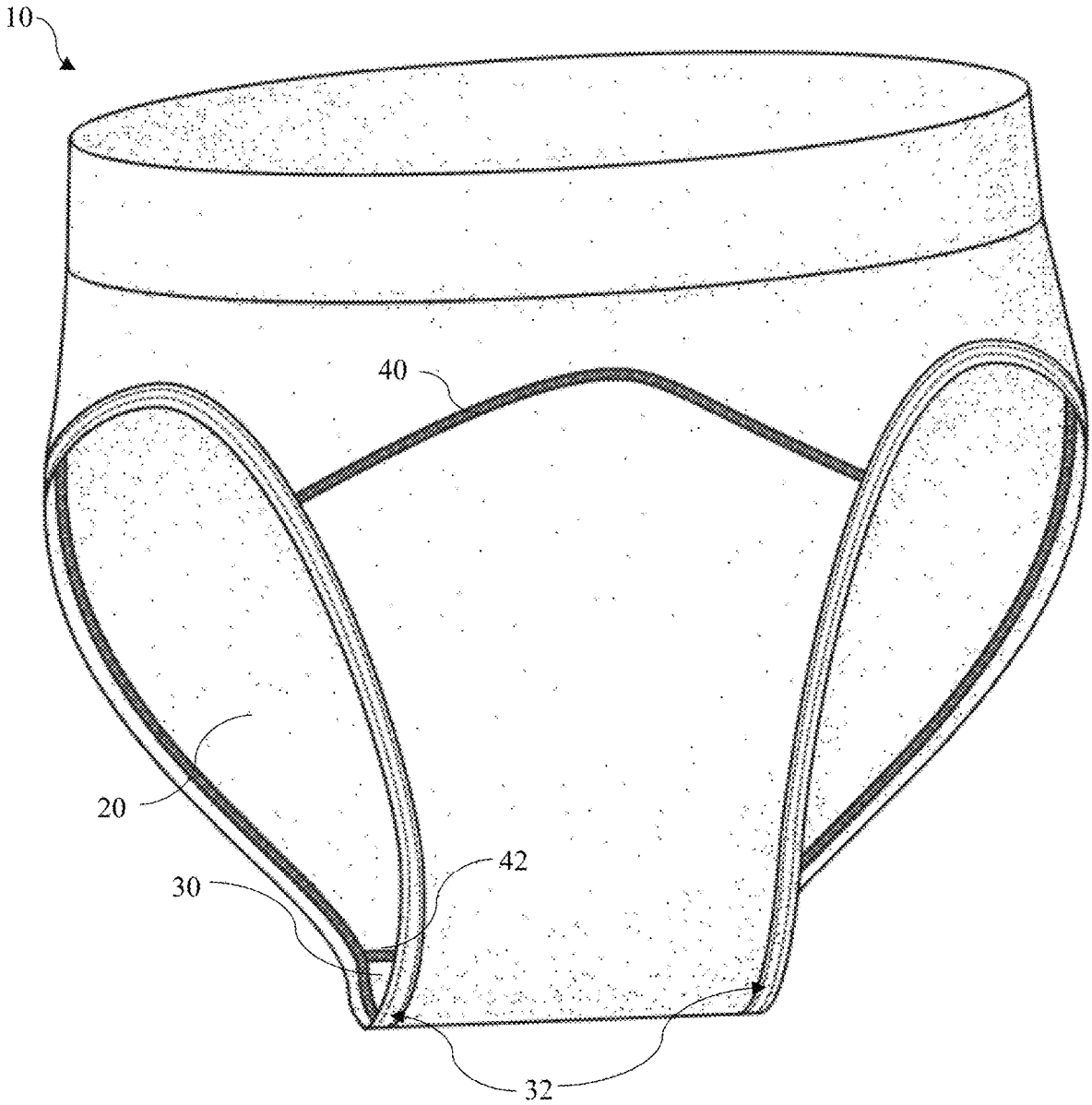
FIG. 5 is a perspective view of the tucking underwear as disclosed herein.
Figure 6:
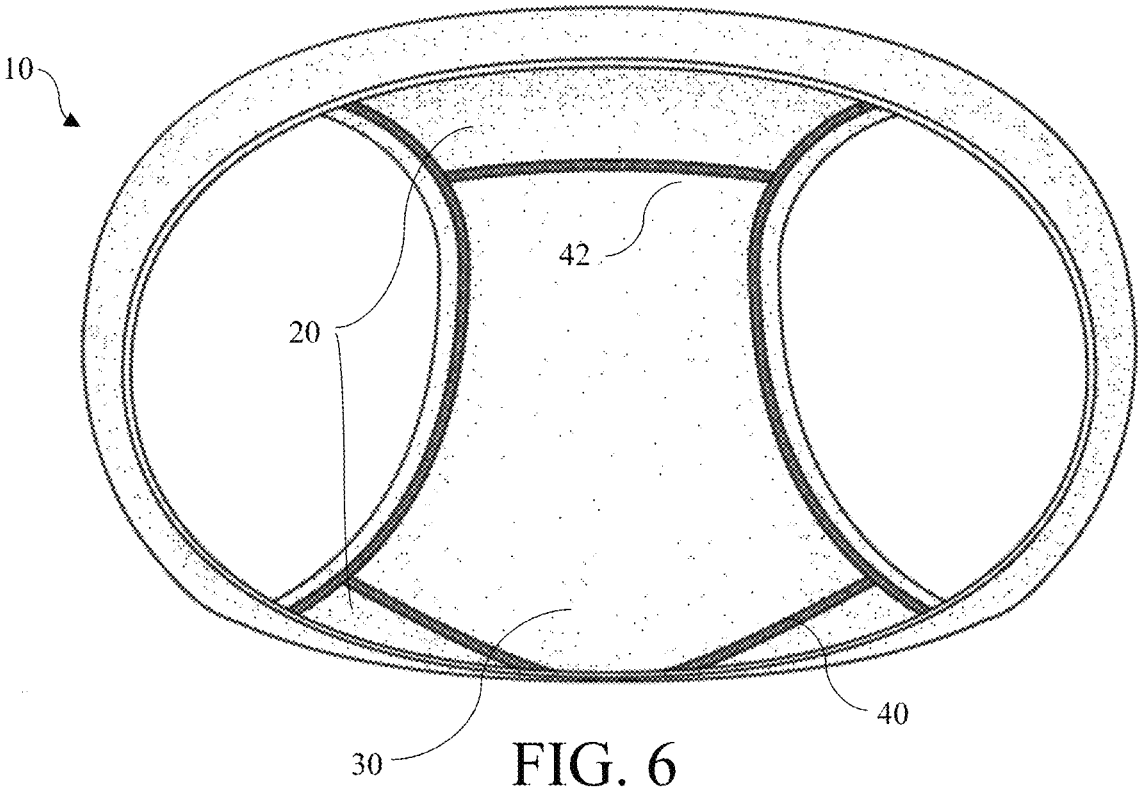
FIG. 6 is a top view of the tucking underwear of FIG. 5.
Figure 7:
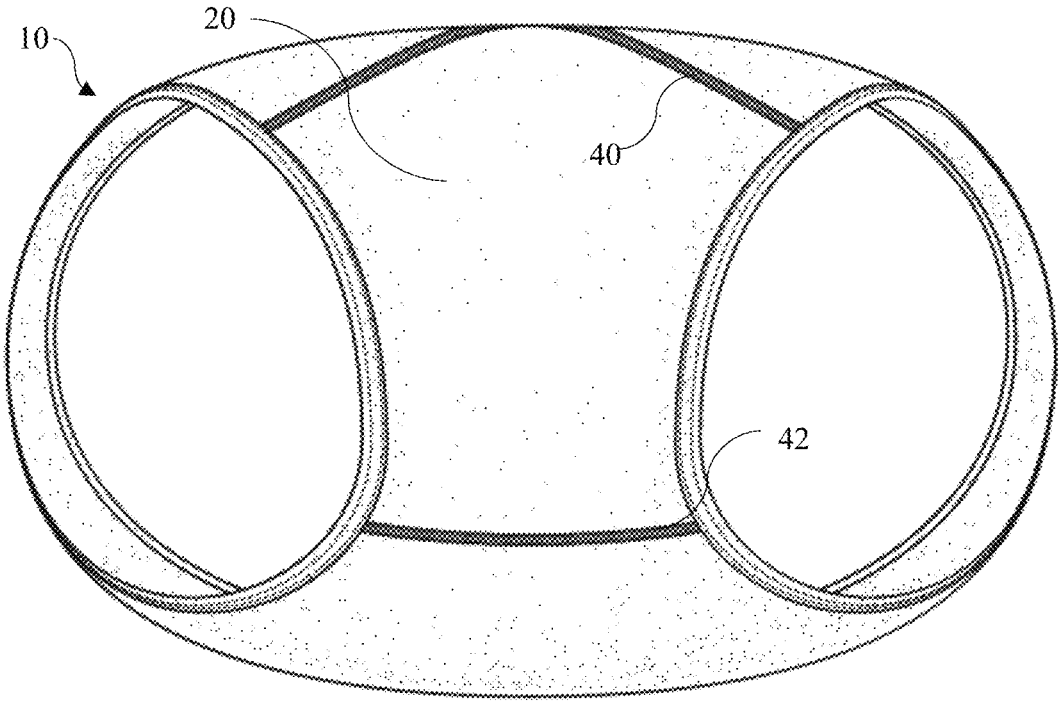
FIG. 7 is a bottom view of the tucking underwear of FIG. 5.

Disclosed herein, in various aspects, and with reference to FIGS. 1-4, is an undergarment 10 comprising a main body 20. The main body 20 can comprise 4-way stretch fabric that is configured to stretch both horizontally and vertically or lengthwise and widthwise at the same time. The main body 20 can define a pair of leg openings 22 spaced along a first axis 12, the main body having a front portion 24 and a rear portion 26 positioned opposite the front portion along a second axis 14 that is perpendicular to the first axis 12. The undergarment 10 can further comprise a compression panel 30 that is positioned to cover the genital area of a wearer assigned male at birth (e.g., male genitals of the wearer). The compression panel 30 can comprise two-way stretch fabric oriented to permit stretching along the first axis and limit stretching along the second axis. The compression panel 30 can provide a smooth and flattened front genital area.

In some aspects, the 4-way stretch fabric can comprise synthetic polymer. For example, the synthetic polymer comprises a blend of polyamide and elastane. Optionally, in these aspects, the synthetic polymer can comprise from about 65% to about 85% polyamide and from about 15% to about 35% elastane. In some aspects, the main body 20 can consist essentially of 4-way stretch fabric. In further aspects, the 4-way stretch fabric can comprise a combination of cotton and elastane (e.g., LYCRA fiber) or a combination of nylon and elastane. In some aspects, the 4-way stretch fabric can be knit. For example, the 4-way stretch fabric can be knit by a circular knitting machine. In some aspects, the circular knitting machine can knit a combination of one or more of nylon, polyester, elastane, or cotton yarns together to form the 4-way stretch fabric. Unlike fabrics provided on a conventional fabric roll that are conventionally used in underwear and, in particular, gaff, the 4-way stretch fabric knit by a circular knitting machine can provide the comfort and effective smoothing properties further described herein. It is contemplated that 4-way stretch knit fabric can have increased stretch and resilience qualities over traditional knit fabrics, easily adapting when subject to tension and returning to its original shape once tension is released.

In some aspects, the compression panel 30 can consist essentially of 2-way stretch fabric. In some aspects, the compression panel 30 can comprise cotton. In some aspects, the compression panel 30 can comprise polyamide or nylon. In some aspects, the 2-way stretch fabric can be knit. For example, the 2-way stretch fabric can be knit by a circular knitting machine.

In some aspects, the compression panel 30 can be coupled to the main body 20 by a first seam 40 extending continuously across the front portion 24 of the main body 20 between the pair of leg openings 22. Optionally, the first seam 40 can comprise a flatlock seam (formed by placing two pieces of fabric side-by-side and sewing the raw edges directly together). In further aspects, the compression panel 30 can be further coupled to the main body 20 by a second seam 42 at an edge of the compression panel 30 opposite the first seam. The second seam 42 can extend continuously between the pair of leg openings 22. In some aspects, second seam 42 can extend across the rear portion 26 of the main body 20. Optionally, the second seam 42 can comprise a flatlock seam (formed by placing two pieces of fabric side-by-side and sewing the raw edges directly together). In some aspects, the first seam 40 can have an arcuate profile.

In some aspects, the compression panel 30 can overlie the main body 20. For example, the main body 20 can define an interior 28, and the compression panel 30 can be positioned within the interior 28 of the main body 20. Optionally, in these aspects, the main body 20 can define an inner surface 29, and the compression panel 30 can be positioned against the inner surface 29 of the main body 20. In alternative aspects, the compression panel 30 can be positioned exterior to the main body 20. In other aspects, edges of the compression panel 30 can adjoin adjacent edges of the main body 20 at the first and second seams 40, 42 so that the compression panel 30 and main body 20 abut and do not overlie each other beyond the first and second seams 40, 42.

In some aspects, the main body 20 can be formed from a unitary sheet of fabric. In some aspects, the main body 20 can be seamless. That is, the main body 20 can be free of seams. This can exclude the first and second seams 40, 42 that adjoin the compression panel 30 to the main body. In other words, the main body 30 can be free of seams that adjoin adjacent portions of the main body to each other. It is contemplated that the main body being seamless can improve comfort over undergarments having more seams. In alternative aspects, the main body 20 can comprise two seams, one on each side (spaced along the first axis 12), joining the front portion 24 to the rear portion 26. The durability of the undergarment 10 can be enhanced by minimizing seams. In this way, the undergarment 10 can be suitable for fitness, swimming or sports. Such activities can cause the undergarment to be pulled and stretched many times during demanding training, which can wear on conventional garments with seams.

The compression panel 20 can have an axis of stretch 34. The axis of stretch 34 can be within 25 degrees of parallel to, within 15 degrees of parallel to, within 10 degrees of parallel to, within 5 degrees of parallel to, substantially parallel to, or parallel to a plane 18 including the first axis 12.

In some aspects, the undergarment 10 can be full-bottomed or full coverage so that the rear portion is configured to cover a majority of a buttocks of the wearer. This can contrast to a cheeky or thong undergarment. The undergarment 10 can be a brief cut. The full-bottomed brief can fit a wider variety of body types and shapes and user preferences compared to traditional tucking underwear styles such as a thong back. Further, the full-bottomed brief cut can be more effective at providing a smooth look than more minimal cuts. Additionally, the full-bottomed brief cut can be more comfortable than more minimal cuts.

In alternative aspects, the undergarment 10 can be configured to partially or minimally cover the buttocks of the wearer, such as a cheeky or thong undergarment.

In some aspects, the undergarment 10 can further comprise a waistband 50. For example, the main body 20 can have an upper edge 52 and the waistband 50 coupled to the upper edge 52 of the main body 20. In further aspects, the waistband can overlie at least a portion of the main body, rather than extending upwardly from the upper edge. In exemplary embodiments, the waistband 50 can have a width from 1 cm to 4 cm, or about 3 cm. The illustrated waistband has an exemplary width. However, other suitable widths are contemplated. Further, more generally, the undergarment can have a different cut, such as, for example, a lower cut, for extending up the waist a lesser amount. In other aspects, the undergarment can be high-waisted, extending, for example, to or above the navel of the wearer.

The undergarment 10 can define a spacing between the pair of leg openings 22. In some optional aspects, the compression panel can extend the entire spacing or substantially the entire spacing between the pair of leg openings 22. In some optional aspects, the main body 20 can define the spacing between the pair of leg openings 22.

The compression panel can comprise a pair of side edge binding trim 32. In some aspects, each side edge binding trim 32 of the pair of edge binding trim can extend along a respective leg opening 22 of the pair of leg openings. The compression panel 30 can be coupled to the main body 20 along each side edge that extends along the respective leg opening. The edge binding trim 32 can be, for example, 140-200 grams per square meter (gsm) (optionally, 160-180 gsm). The edge binding trim 32 can be a lower weight than both the 2-way stretch fabric and the 4-way stretch fabric. Further, the edge binding trim 32 can be applied using a single fold one sided sewing technique for a minimal profile.

It is contemplated that providing portions of the leg opening formed by both 2-way and 4-way fabric can have advantageous performance. For example, providing portions of the leg opening 22 formed by both 2-way and 4-way stretch fabric can provide for consistent conformity of the entire leg binding to the body, minimizing gapping when the body moves or flexes.

In exemplary aspects, the compression panel 30 can have a length from about 15 cm to about 30 cm, or from about 20 cm to about 25 cm. Said length can be measured along the surface of the compression panel 30 from the first seam 40 to the second seam 42. In aspects in which the first seam 40 has an arcuate profile, the length can be measured from a center of the second seam 42 along the second axis 14 to a center of the first seam 40. In some aspects, a dimension from a top of the waistband 50 to the first seam 40 can be from about 5 cm to 10 cm (e.g., measured to a center of the first seam 40 in aspects in which the first seam 40 is arcuate). In some aspects, a dimension from a top of the waistband 50 to the second seam 42 can be from about 20 cm to about 35, or from about 25 cm to about 30 cm. The dimensions of the compression panel 30 can be selected to fit the user. For example, the dimensions can differ for small, medium, large, extra-large sizes. The first seam 40 can have a width along the second axis 14 from about 15 cm to about 20 cm. The second seam 42 can have a width along the second axis 14 from about 8 cm to about 14 cm. The dimensions of the compression panel 30 can be selected to fit the user. For example, the dimensions can differ for small, medium, large, extra-large sizes.

It is contemplated that a layer of 4-way stretch fabric and an overlying layer of 2-way fabric layer can provide an advantageous combination of comfort and performance (e.g., smooth look). However, it is further contemplated that the 4-way stretch fabric and 2-way stretch fabric need not overlie each other. More generally, an undergarment can comprise a main body comprising 4-way stretch fabric. The undergarment can further comprise a compression panel that is positioned to cover the genital area of a wearer assigned male at birth (e.g., male genitals of the wearer). The compression panel can comprise two-way stretch fabric oriented to permit stretching along the first axis and limit stretching along the second axis. The main body and the compression panel can cooperate to define a pair of leg openings spaced along a first axis. The main body can define a rear portion of the undergarment, and the compression panel can define a front portion of the undergarment.

The disclosed underwear can include fabric not conventionally used in undergarments. For example, the 4-way stretch fabric and/or the 2-way stretch fabric can have a heavier gauge/weight than fabrics conventionally used in undergarments such as seamless or regular mid to low rise underwear. For example, the 4-way stretch fabric and/or the 2-way stretch fabric can have a weight from 180 to 300 grams per square meter (gsm). Optionally, in these aspects, the 4-way stretch fabric and/or the 2-way stretch fabric can have a weight from 200 to 260 gsm. For example, the 4-way stretch fabric and/or the 2-way stretch fabric can have a weight of at least 180 gsm. In further aspects, the 4-way stretch fabric and/or the 2-way stretch fabric can have a weight of at least 200 gsm. In still further aspects, the 4-way stretch fabric and/or the 2-way stretch fabric can have a weight of at least 230 gsm. The 4-way stretch fabric extending upwardly from the first seam in the front, combined with the 4-way stretch fabric above the second seam 42 the full rear allows for a more expanded fit potential at the waist area and rear buttocks area. Thus, the compression panel stays comfortably flat and smooth, with the rest of the garment (beyond the compression panel) providing mild overall compression to create a superior fit over conventional gaff. Further, the 4-way stretch fabric and/or the 2-way stretch fabric can have more elastane than fabrics conventionally used in undergarments. For example, the 4-way stretch fabric and/or the 2-way stretch fabric can have from 20-30% elastane by weight. In contrast, conventional panties can have an elastane composition in the 5-10% range. The fabrics can disclosed herein can support, mold and compress parts of the body better than conventional fabrics. For example, the 4-way stretch fabric can compress and mold the body shape, while providing comfort for long periods. The use of heavy-gauge 4-way fabric that overlies and surrounds the compression panel, being very compressive, acts to shape the body. The 4-way stretch knit weave enables the undergarment to offer the wearer the ability to wear it all day long in comfort, without an uncomfortable compressive feeling. Further, the fabric has the ability to fit a wider range of body sizes and shapes. In some aspects, the 4 way stretch fabric can provide the smoothness and comfort of the undergarment, enhanced by the assistance of the 2-way stretch fabric (e.g., cotton liner) of the compression panel.

The combination of the compression panel and the 4-way stretch fabric cooperate in a unique way to keep the tucked genitals flat, smooth and in place for very long periods of time with much less discomfort. The heavier weight knitted compression 4-way stretch fabric that overlies the panel can allow the genitals to stay flat and tucked, while permitting the edge binding trim to stretch and grip the inner leg area, thereby eliminating garment gaping at the sides of the crotch.

Furthermore, the combination of the 4-way stretch knitted compression fabric placed above the front arc seam, as well as in the full rear, gives further support to the front compression panel by allowing the waistband and full back panel to have 4-way seamless body shaping performance. For example the 4-way stretch knitted compression fabric above the first and second seams 40, 42 on the front and rear, respectively, allows the compression panel to hold a smooth and flat front appearance, while allowing the 4-way stretch body shaping material to more easily stretch across a waistline and buttocks for a comfortable experience for the wearer. By providing the compression panel as a partial panel that extends only partially up the front, but not to the waist line, the compression panel does not inhibit stretching at the waistline. It is contemplated that extending the compression panel farther up or to the waistline could diminish the comfort and fit of the undergarment.

The disclosed undergarment can have myriad advantages over conventional tucking underwear. It is contemplated that 4-way stretch knit fabric combined with the two-way stretch compression panel over the pubic area that has limited to no seams is more comfortable for the user. The disclosed undergarment has fewer overall seams and stitching in the garment compared to traditional underwear. Said conventional seams can cause chafing or other friction against the body during wear. In use, 4-way stretch fabric can move with the body causing less restriction during movement, and it is contemplated that the undergarment can be worn for a longer period (e.g., throughout the day) with little to no discomfort. The 4-way stretch knit fabric combined with the two-way stretch compression panel can create a more comfortable overall experience similar to normal underwear for the user that needs little or no tucking readjustment during wear. Stated another way, the wearer benefits from smooth flat front appearance without the traditional constant uncomfortable compressive fit and feel which is common in traditional tucking gaff panties, as well as requiring little or no tucking readjustment during wear.

The disclosed undergarment can create a smooth outline, covering and reducing detail of the pubic and genital area. This improvement can allow a wider variety of body types (including shape and size) to wear the product. The undergarment can provide a smoothing effect on the body and skin due to the strength and stretch of the knit fabric assisted by the 2-way stretch fabric (e.g., cotton liner). The disclosed undergarment can allow for the user to wear clothing such as pants, leggings, skirts, dresses or other body contouring apparel without protrusion (e.g., male genital protrusion) from the pubic area. Further, the disclosed undergarment can produces less visible seam/panty lines along the buttocks. For example, the visible seam/panty lines can be minimized as a function of the thinness of the 4-way stretch knit material and minimal edge binding trim.

The compression panel of the disclosed undergarment can allow for multiple tucking techniques (simple pull over or inguinal insertion) providing for a wider range of users and body types to wear the garment.

The combination of flatlock stitching and seamless knit main body can produce a lower profile stitch creating a more comfortable, less bulky garment for the user which allows for wearing under more body-conscious or contouring clothing while providing for compression and smoothing of the front pubic and genital area.

The minimization of seams and use of flatlock seams allows the garment to compress at an effective level without causing discomfort or chafing.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: An undergarment comprising:

a main body comprising 4-way stretch fabric, the main body defining a pair of leg openings spaced along a first axis, the main body having a front portion and a rear portion positioned opposite the front portion along a second axis; and a compression panel that is positioned to cover a genital area of a wearer assigned male at birth, wherein the compression panel comprises two-way stretch fabric oriented to permit stretching along the first axis and limit stretching along the second axis.

Aspect 2: The undergarment of aspect 1, wherein the main body consists essentially of 4-way stretch fabric.

Aspect 3: The undergarment of aspect 1 or aspect 2, wherein the compression panel consists essentially of 2-way stretch fabric.

Aspect 4: The undergarment of any one of the preceding aspects, wherein the compression panel is coupled to the main body by a first seam extending continuously across the front portion of the main body between the pair of leg openings.

Aspect 5: The undergarment of aspect 4, wherein the compression panel is further coupled to the main body by a second seam extending continuously across the rear portion of the main body between the pair of leg openings.

Aspect 6: The undergarment of aspect 4 or aspect 5, wherein the first seam comprises a flatlock stitch.

Aspect 7: The undergarment of aspect 5 or aspect 6, wherein the second seam comprises a flatlock stitch.

Aspect 8: The undergarment of any one of the preceding aspects, wherein the 4-way stretch fabric comprises synthetic polymer.

Aspect 9: The undergarment of aspect 8, wherein the synthetic polymer comprises a blend of polyamide and elastane.

Aspect 10: The undergarment of aspect 9, wherein the synthetic polymer comprises about from about 65% to about 85% polyamide and about 15% to 35% elastane.

Aspect 11: The undergarment of any one of the preceding aspects, wherein the 4-way stretch fabric comprises cotton.

Aspect 12: The undergarment of any one of the preceding aspects, wherein the 4-way stretch fabric consists essentially of cotton.

Aspect 13: The undergarment of any one of the preceding aspects, wherein the 4-way stretch fabric comprises a combination of cotton and synthetic polymer.

Aspect 14: The undergarment of any one of the preceding aspects, wherein the compression panel comprises cotton.

Aspect 15: The undergarment of any one of the preceding aspects, wherein the main body defines an interior, wherein the compression panel is positioned within the interior of the main body.

Aspect 16: The undergarment of aspect 15, wherein the main body defines an inner surface, wherein the compression panel is positioned against the inner surface of the main body.

Aspect 17: The undergarment of any one of the preceding aspects, wherein the main body is seamless.

Aspect 18: The undergarment of any one of the preceding aspects, wherein the main body is formed from a unitary sheet of fabric.

Aspect 19: The undergarment of any one of the preceding aspects, wherein the compression panel has an axis of stretch, wherein the axis of stretch is within 10 degrees of parallel to a plane including the first axis.

Aspect 20: The undergarment of any one of the preceding aspects, wherein the undergarment is full-bottomed so that the rear portion is configured to cover a majority of a buttocks of the wearer.

Aspect 21: The undergarment of any one of the preceding aspects, wherein the main body has an upper edge, the undergarment further comprising a waistband coupled to the upper edge of the main body.

Aspect 22: The undergarment of any one of the preceding aspects, wherein the 4-way stretch fabric is knit fabric.

Aspect 23: The undergarment of any one of the preceding aspects, wherein the 2-way stretch fabric is knit fabric.

Aspect 24: The undergarment of any one of the preceding aspects, the main body defines a spacing between the pair of leg openings, wherein the compression panel extends the entire spacing or substantially the entire spacing of the main body between the pair of leg openings.

Aspect 25: The undergarment of any one of the preceding aspects, wherein the compression panel comprises a pair of edge binding trim, each edge binding trim of the pair of edge binding trim extending along a respective leg opening of the pair of leg openings, wherein the compression panel is coupled to the main body along each edge binding trim that extends along the respective leg opening.

Aspect 26: An undergarment comprising:

a main body comprising 4-way stretch fabric; and a compression panel that is positioned to cover male genitals of the wearer, wherein the compression panel comprises two-way stretch fabric oriented to permit stretching along the first axis and limit stretching along the second axis, wherein the main body and the compression panel cooperate to define a pair of leg openings spaced along a first axis, wherein the main body defines a rear portion of the undergarment, and wherein the compression panel defines a front portion of the undergarment.

Those skilled in the art will recognize, or be able to ascertain using no more than routine experimentation, many equivalents to the specific embodiments of the method and compositions described herein. Such equivalents are intended to be encompassed by the following claims.

What is claimed is:

1. An undergarment comprising: a main body comprising 4-way stretch fabric, the main body defining a pair of leg openings spaced along a first axis, the main body having a front portion and a rear portion positioned opposite the front portion along a second axis, wherein the 4-way stretch fabric is knit fabric formed on a circular knitting machine; and a compression panel that is positioned to cover a genital area of a wearer assigned male at birth, wherein the compression panel overlies the 4-way stretch fabric of the main body portion, wherein the compression panel comprises two-way stretch fabric oriented to permit stretching along the first axis and limit stretching along the second axis, wherein the undergarment is tucking underwear, and wherein the compression panel of the tucking underwear is attached to the main body so that the compression panel is configured to apply a compressive force to genitals of the wearer to provide a flattened appearance of the genitals; wherein the main body consists 4-way stretch fabric; further comprising a waistband, wherein the compression panel is secured to the main body portion at a first seam that is spaced from the waistband along a vertical axis that is perpendicular to each of the first and second axes.

2. The undergarment of claim 1, wherein the compression panel is coupled to the main body by a first seam extending continuously across the front portion of the main body between the pair of leg openings.

3. The undergarment of claim 2, wherein the compression panel is further coupled to the main body by a second seam extending continuously across the rear portion of the main body between the pair of leg openings, wherein the first seam comprises a flatlock stitch.

4. The undergarment of claim 1, wherein the 4-way stretch fabric comprises synthetic polymer.

5. The undergarment of claim 4, wherein the synthetic polymer comprises a blend of polyamide and elastane.

6. The undergarment of claim 1, wherein the 4-way stretch fabric comprises cotton.

7. The undergarment of claim 1, wherein the compression panel comprises cotton.

8. The undergarment of claim 1, wherein the main body defines an interior, wherein the compression panel is positioned within the interior of the main body.

9. The undergarment of claim 1, wherein the main body is seamless.

10. The undergarment of claim 1, wherein the compression panel has an axis of stretch, wherein the axis of stretch is within 10 degrees of parallel to a plane including the first axis.

11. The undergarment of claim 1, wherein the undergarment is full-bottomed so that the rear portion is configured to cover a majority of a buttocks of the wearer.

12. The undergarment of claim 1, wherein the 2-way stretch fabric is knit fabric.

13. The undergarment of claim 1, the main body defines a spacing between the pair of leg openings, wherein the compression panel extends the entire spacing or substantially the entire spacing of the main body between the pair of leg openings.

14. The undergarment of claim 1, wherein the compression panel comprises a pair of edge binding trim, each edge binding trim of the pair of edge binding trim extending along a respective leg opening of the pair of leg openings, wherein the compression panel is coupled to the main body along each edge binding trim that extends along the respective leg opening.

15. The undergarment of claim 1, wherein the undergarment has an innermost surface configured to contact skin of the wearer, wherein the compression panel defines at least a portion of the innermost surface of the undergarment.

16. The undergarment of claim 15, wherein the compression panel has an outwardly facing surface, wherein the 4-way stretch fabric of the main body has in inwardly facing surface, wherein the outwardly facing surface of the compression panel contacts the inwardly facing surface of the 4-way stretch fabric of the main body.

17. The undergarment of claim 16, wherein the compression panel is a single layer of the two-way stretch fabric.

18. An undergarment comprising: a main body comprising 4-way stretch fabric; and a compression panel that is positioned to cover male genitals of the wearer, wherein the compression panel comprises two-way stretch fabric oriented to permit stretching along a first axis and limit stretching along a second axis, wherein the 4-way stretch fabric is knit fabric formed on a circular knitting machine, wherein the underwear has an innermost surface configured to contact skin of the wearer, wherein the compression panel defines at least a portion of the innermost surface of the underwear, wherein the main body and the compression panel cooperate to define a pair of leg openings spaced along the first axis, wherein the main body defines a rear portion and a front portion of the undergarment, and wherein the compression panel attached to the front portion of the undergarment, wherein the undergarment is tucking underwear, and wherein the compression panel of the tucking underwear is attached to the main body so that the compression panel is configured to apply a compressive force to genitals of the wearer to provide a flattened appearance of the genitals; wherein the main body consists 4-way stretch fabric; further comprising a waistband, wherein the compression panel is secured to the main body portion at a first seam that is spaced from the waistband along a vertical axis that is perpendicular to each of the first and second axes.

* * * * *